United States Patent [19]

Scheinecker et al.

[11] 4,015,656

[45] Apr. 5, 1977

[54] STRAND GUIDING MEANS FOR GUIDING A STRAND CONTINUOUSLY CAST IN A CONTINUOUS CASTING PLANT

[75] Inventors: Alois Scheinecker; Gunter Holleis, both of Linz, Austria

[73] Assignee: Vereinigte Osterreichische Eisen- und Stahlwerke-Alpine Montan Aktiengesellschaft, Linz, Austria

[22] Filed: Jan. 5, 1976

[21] Appl. No.: 646,670

[30] Foreign Application Priority Data

Jan. 7, 1975 Austria ..... 59/75

[52] U.S. Cl. ..... 164/282

[51] Int. Cl.[2] ..... B22D 11/128

[58] Field of Search ..... 164/282; 193/35 R; 226/189

[56] References Cited

UNITED STATES PATENTS

| | | | |
|---|---|---|---|
| 479,829 | 8/1892 | McCarthy | 193/35 R UX |
| 2,600,747 | 6/1952 | Faust | 193/35 R X |
| 3,480,075 | 11/1969 | Varaxin et al. | 164/282 X |
| 3,542,117 | 11/1970 | Lemper et al. | 164/282 X |
| 3,638,713 | 2/1972 | Knell et al. | 164/282 X |
| 3,718,177 | 2/1973 | Wagner, Jr. | 164/282 |

FOREIGN PATENTS OR APPLICATIONS

| | | | |
|---|---|---|---|
| 46-31,667 | 9/1971 | Japan | 164/282 |
| 93,821 | 4/1959 | Norway | 193/35 R |

*Primary Examiner*—Ronald J. Shore
*Attorney, Agent, or Firm*—Brumbaugh, Graves, Donohue & Raymond

[57] ABSTRACT

A strand guiding apparatus to be used in a continuous casting plant has a frame for the supporting devices of the strand, which frame is actuated by an adjustment means having a displacement ruler detachably connected to the frame by means of a quick lock. Upon release of the quick lock and retraction of the displacement ruler, the frame can be removed vertically upwardly.

11 Claims, 3 Drawing Figures

STRAND GUIDING MEANS FOR GUIDING A STRAND CONTINUOUSLY CAST IN A CONTINUOUS CASTING PLANT

BACKGROUND OF THE INVENTION

The invention relates to a strand guide for continuous casting plants having a frame or section that can be actuated by an adjustment means. The supporting means, such as plates or rolls, are arranged and are adjustable to one side of the cast strand. Such strand guides are particularly necessary for the lateral support of cast strands having a molten core and a relatively thin strand skin which are produced in high capacity casting plants that cast slabs.

In known strand guides the supporting elements consist of plates, rollers or rolls. They are arranged in frames which are either rigidly connected with the carrying structure of the secondary cooling zone or are adjustable to the strand by means of an actuating drive.

In German Patent No. 1,558,210, a supporting or transport roll means for continuous casting plants is disclosed, which has rolls that can be urged to one side of the strand by means of force-actuated adjustment means. These rolls are arranged on a section that is articulately connected with the adjustment means. The adjustment is infinitely variable.

In known strand guides of the described kind there is a problem in that the adjustment of the supporting means to different sizes, i.e. to different frame thicknesses and widths, is time-consuming and complicated, because a precise adjustment by means of gauges is necessary and the supporting elements have to be manually secured in their new positions by means of screws or wedges. A further significant disadvantage of known strand guides cosists in that the supporting means contacting the strand, together with the frame to which they are secured, the adjustment means and the drive mechanism, are destroyed when the molten steel breaks through because they weld together with the outflowing steel.

A further disadvantage of known strand guides consists in the fact that by the adjustment of the supporting means to the strand skin without a defined stop, e.g. by means of a hydraulic cylinder, no defined position, constant throughout the entire casting procedure, relative to the lower edge of the mould copper plate, is guaranteed, whereby cracks can form on the slab.

SUMMARY OF THE INVENTION

The invention aims at preventing the above described disadvantages and difficulties and has as its object to provide a strand guide for continuous casting plants in which the part of the guide carrying the acutal means in a quick and easy manner. A further object of the invention is to provide an adjustment to different strand sizes in an operationally safe manner and without manual labor.

The construction according to the invention with which these objects are achieved comprises a strand guide of the above defined kind, in which the section or the frame is detachably connected to a displacement ruler of the adjustment means by means of a quick lock, preferably by means of an upwardly open double hook, so that the section or the frame can be removed vertically upward after release of the quick lock and retraction of the displacement ruler to a position out from under the mould.

Thus, if the steel brakes through below the mould, the displacement ruler and the whole actuating drive can be saved, while only the relatively inexpensive and light frame part carrying the supporting means is lost.

According to an advantageous embodiment of the invention, the section or frame, is arranged on an intermediate part of the displacement ruler so as to be pivotable in the direction towards the strand, whereby a precise adjustment of the supporting rollers or plates, to the strand surface is possible.

A preferred constructive solution for achieving such a precise adjustment comprises hanging the section or frame, into double hooks on the intermediate piece by means of two pins, a lower and an upper pin, wherein the lower pin is rigid and the upper pin is eccentric and rotatable.

According to a preferred embodiment a stop roller is provided on the frame, which roller coacts with a stop on the carrying structure or on the mould in order to define the position of the supporting rollers during the casting operation. A movement in the direction of the operational load is prevented by a self-locking drive unit or a reaction force that is greater than the operational load.

Suitably, a breaking piece, e.g. screws, is provided between the displacement ruler and the intermediate piece.

BRIEF DESCRIPTION OF THE DRAWINGS

The invention shall now be described in more detail by way of an example and with reference to the accompanying drawings, wherein.

DESCRIPTION OF THE PREFERRED EMBODIMENT

Figure 1:
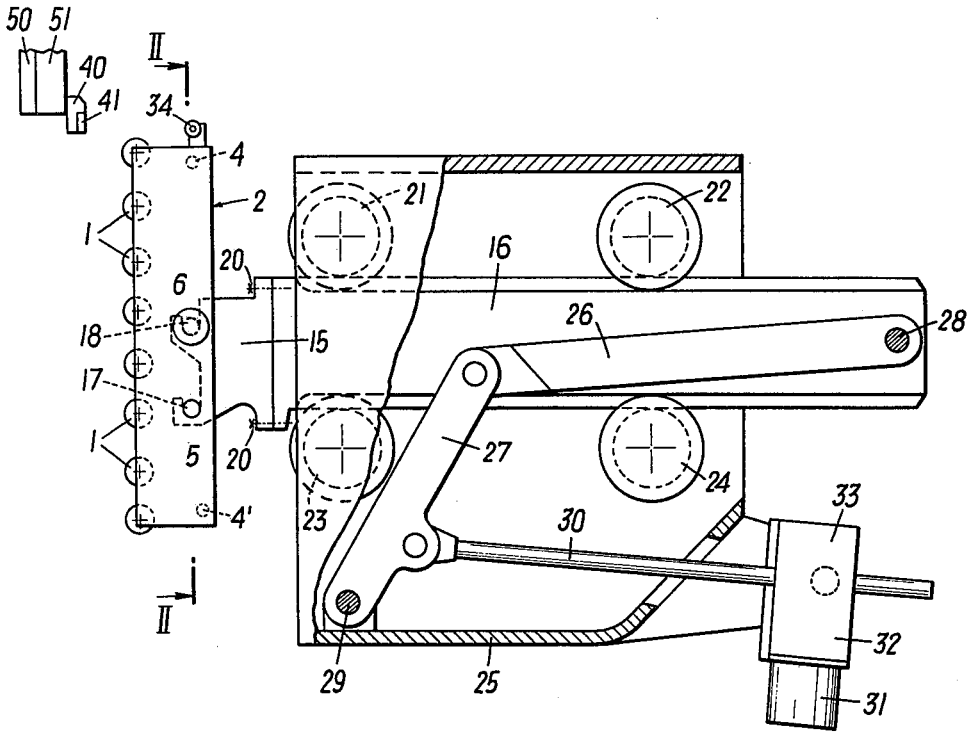
FIG. 1 is a side view, in partial section, of the strand guide, including the actuating drive.
Figure 2:
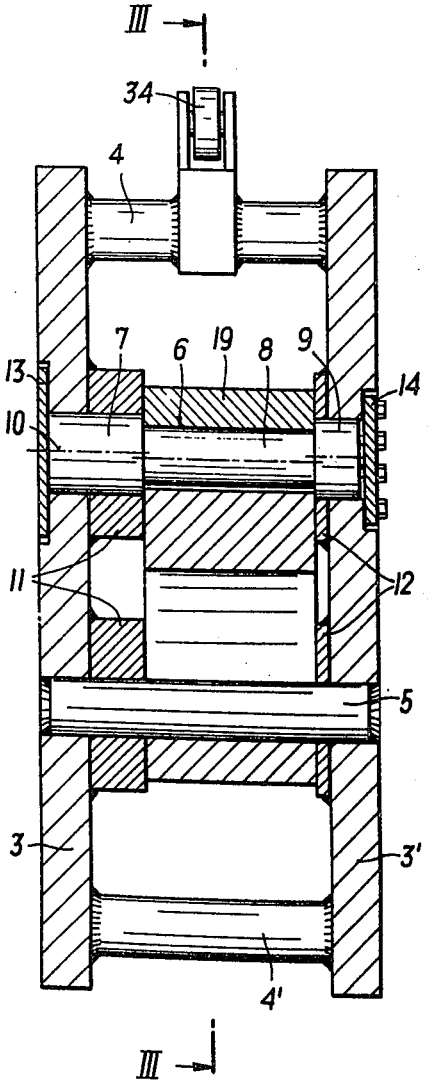
FIG. 2 is a vertical section along line II—II of FIG. 1 on a larger scale.

According to FIG. 1, the supporting element designed as rollers 1 are mounted in the frame 2, which has two vertical plates 3 and 3', connected by the pins 4 and 4' (FIG. 2). In the frame 2, two further horizontal pins 5 and 6 are provided. The lower pin 5 is rigidly connected with the vertical plates, while the upper pin 6 is rotatably mounted. Pin 6 has three offset cylindrical parts 7, 8 and 9, wherein the two outer parts 7 and 9 have a common axis of rotation 10, while the axis of the middle part 8 is eccentrically displaced relative to the axis 10. Distance plates 11 and 12 are secured to the vertical plates and accommodate the pins 5 and 6. The upper rotatable pin 6 is kept in its position by lids 13 and 14. By rotating the pin 6, the eccentric part 8 and thus the whole frame 2 along with the supporting rollers 1 is pivoted, i.e. its inclination relative to the vertical is altered, whereby a precise adjustment relative to the strand surface is possible.

The frame 2 is connected to an intermediate piece or part 15 of a displacement ruler 16 by means of its pins 5 and 6, the pins 5 and 6 being hung on upwardly open hooks 17 and 18 of part 15. A safety platelet 19 is detachably secured to part 14 and prevents an undesired lifting of the frame 2. The intermediate piece 15 is connected to the displacement ruler 16 by means of a breaking piece, e.g. screws 20.

If a break-through of the core of the casting occurs, it is the purpose of the intermediate piece 15 to provide for the separation of the frame 2 or the intermediate piece 15 itself from the displacement ruler 16 at the hooks 17 and 18 or the predetermined breaking pieces 20, respectively, thereby preventing the destruction of the displacement ruler 16 and its guide and drive elements.

The displacement ruler 16 is guided in the horizontal direction by means of at least two opposing pairs of rollers (21 and 23, and 22 and 24) which are mounted in a housing 25 (FIG. 1). The ruler 16 actuated by a toggle lever linkage comprising the connecting rods 26 and 27. Advantageously, the housing 25 can be fixed on the mould guides, which are not shown in detail. The connecting rods 26 and 27 are articulately mounted in the housing by means of pins 28 and 29. A push rod 30 engages the connecting rod 27 and is actuated by a motor 31 via a self-locking intermediate gearing 32. The intermediate gearing may e.g. consist of a worm wheel and a worm, wherein the central bore of the worm wheel is designed as a spindle nut and the end of the push rod 30 is designed as a spindle. A hydromotor with a small capacity can be used as the motor. The motor and the intermediate gearing are pivotably mounted in bearing 33.

Figure 3:
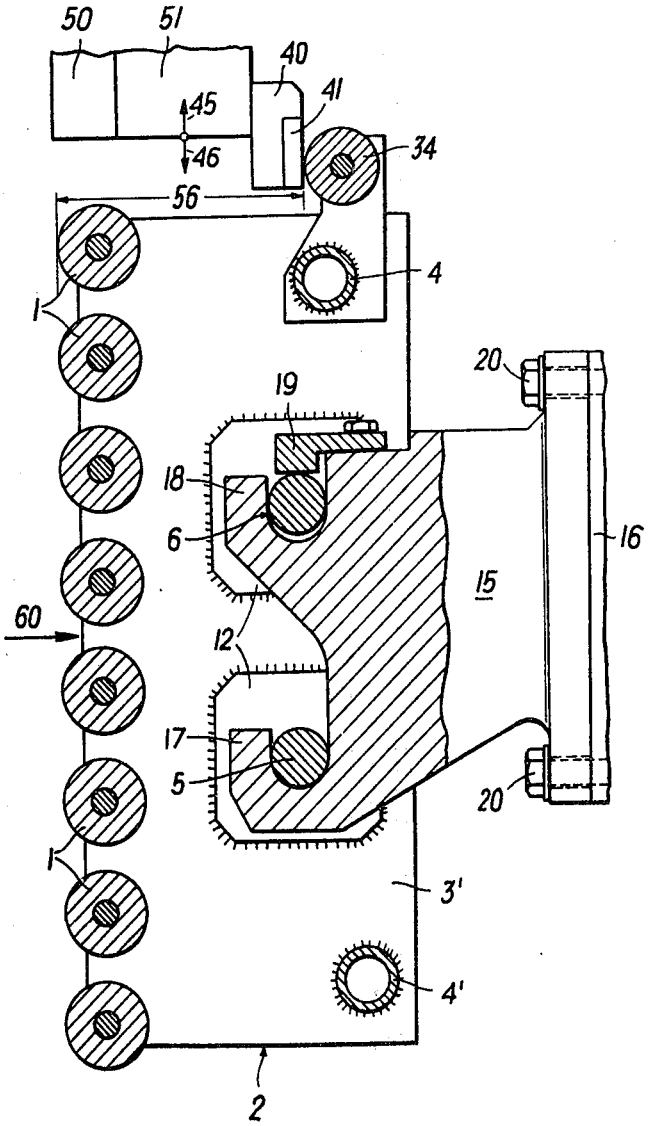
FIG. 3 is a section along line III—III of FIG. 2.

The apparatus functions in the following way: The frame carrying the supporting means is secured by means of the platelet 19 after insertion into the double-hook-shaped quick lock 17 and 18, and it is brought into the correct position by means of the displacement ruler 16. A roller 34 secured to the frame 2 or to the connecting pin 4, coacts with a stop on the carrying structure or on the mould. In FIG. 3 the stop roller is shown moving towards a stop 40 that is arranged on a supporting plate 51 for the end wall 50 of the mould. The stop 40 carries a wear plate 41. The stop roller 34 rolls on the wear plate 41, since the mould reciprocates in the direction of the arrows 45 and 46.

This stop roller 34 serves mainly to guarantee a precise positioning of the copper plate 50 and the rollers 1 relative to one another during operation, of the plant, which position is given by the exact distance 56.

When an operational load 60 is applied to the frame 2 the self-locking intermediate gearing 32 prevents the frame 2 from being pushed away from the slab, i.e. the stop 40, the stop roller 34, and the intermediate gearing 32 guarantee that the frame does not change its position during casting, something that is necessary for obtaining a perfect quality slab. An indicator means may be present showing the exact position of the supporting rollers.

In case of a disturbance during operation, e.g. a breakthrough of steel, only the screws 20 between the intermediate piece 15 and the displacement ruler 16 need be released in order to separate the frame and intermediate piece from the ruler 16. Alternatively, the safety platelet 19 can be screwed off or knocked off, whereupon the frame can be removed by being lifted from the double-hook shaped quick lock. This rapid detachment can be carried out so quickly that destruction of the displacement ruler and the adjustment mechanism can be prevented.

Of course, other known drive means can be substituted for the toggle lever linkage adjustment means shown in the drawings. Thus it is possible to arrange, e.g., a tooth rack on the displacement ruler which meshes with a pinion that is driven by a worm gear via a vertical universal joint propeller shaft. Another possibility for the horizontal drive has a hydraulic cylinder arranged on the housing and a stop arranged on the displacement ruler, wherein the piston rod of the cylinder is connected to the stop via a joint, so that the piston rod acts directly upon the displacement ruler.

What we claim is:

1. A strand guiding means for guiding one side of a strand continuously cast in a continuous casting plant having a carrying structure and a continuous casting mould, the strand guiding means comprising:

a frame part carrying support elements for said strand;

an adjustment means for adjusting said frame part relative to the strand both toward said strand and away from said strand a sufficient distance to allow said frame part to clear the mould, which adjustment means includes a displacement ruler; and quick locking means detachably connecting said frame part with said displacement ruler to allow for a vertically upward removal of said frame part after release of said quick locking means and retraction of said displacement ruler.

2. A strand guiding means as set forth in claim 1, wherein the supporting elements are plates.

3. A strand guiding means as set forth in claim 1, wherein the supporting elements are rollers.

4. A strand guiding means as set forth in claim 1, wherein the quick locking means is an upwardly open double hook with a detachable platelet to close off part of the hook.

5. A strand guiding means as set forth in claim 1, wherein the displacement ruler comprises an intermediate piece secured to the frame part in such a way that the frame part is pivotable in the direction toward the strand, thereby allowing for a precise adjustment of the support elements relative to the strand.

6. A strand guiding means as set forth in claim 1, wherein said frame part has an upper pin and a lower pin, said lower pin being rigid and said upper pin being eccentrically structured and rotatable, said upper pin comprising two outer cylindrical parts mounted in the frame part and a third cylindrical part arranged therebetween and offset relative to the two outer cylindrical parts, the two outer cylindrical parts having a common axis of rotation and the third cylindrical part having an axis that is eccentrically displaced relative to the common axis of rotation of the two outer cylindrical parts.

7. A strand guiding means as set forth in claim 1, further comprising a stop roller provided on the frame part and a stop provided on the carrying structure, the stop roller coacting with the stop for defining the position of the supporting elements during casting.

8. A strand guiding means as set forth in claim 1, further comprising a stop roller provided on the frame part and a stop provided on the mould, the stop roller coacting with the stop for defining the position of the supporting elements during casting.

9. A strand guiding means as set forth in claim 5, wherein a breaking means is provided between the displacement ruler and the intermediate piece.

10. A strand guiding means as set forth in claim 9, wherein the breaking means are screws.

11. A strand guiding means for guiding one side of a strand continuously cast in a continuous casting plant having a carrying structure and a continuous casting mould, the strand guiding means comprising:

a frame part carrying supporting elements for said strand, said frame part having a lower pin and an upper pin, said lower pin being rigid and said upper pin being eccentrically structured and rotatable;

an adjustment means for adjusting said frame part relative to the strand both toward said strand and away from said strand a sufficient distance to allow said frame part to clear the mould, which adjustment means includes a displacement ruler having an intermediate piece secured to said frame part in such a way that the frame part is pivotable in the direction toward the strand; and quick locking means detachably connecting said frame part with said displacement ruler to allow for a vertically upward removal of said frame part after release of said quick locking means and retraction of said displacement ruler, said quick locking means being formed by a double hook provided on the intermediate piece, the upper and lower pins of the frame part being hung in the double hook, at least one of said pins being retained in said hook by means of a detachable platelet.

* * * * *

UNITED STATES PATENT AND TRADEMARK OFFICE

CERTIFICATE OF CORRECTION

PATENT NO. : 4,015,656

DATED : Apr. 5, 1977

INVENTOR(S) : Alois Scheinecker et al

It is certified that error appears in the above-identified patent and that said Letters Patent are hereby corrected as shown below:

COL. 1, line 36, "cosists" should read --consists--;
line 54, "acutal" should read --actual supporting means is detachable from the adjustment--.

COL. 2, line 6, after "frame" delete the comma;
line 9, after "plates" delete the comma;
line 13, after "frame" delete the comma;
line 38, "THE PREFERRED" should read --A PREFERRED--;
line 63, "part 14" should read --part 15--.

COL. 3, line 10, after "16" insert --is--;
line 40, after "operation" delete the comma.

Signed and Sealed this

Fourteenth Day of June 1977

[SEAL]

*Attest:*

RUTH C. MASON
*Attesting Officer*

C. MARSHALL DANN
*Commissioner of Patents and Trademarks*